United States Patent [19]

Hidding et al.

[11] Patent Number: 5,050,757

[45] Date of Patent: Sep. 24, 1991

[54] CONTAINER SYSTEM

[76] Inventors: Daniel P. Hidding, Rte. 2 Ridgecraft La., Barrington Hills, Ill. 60010; David E. Hidding, 284 W. Old Plum Grove Rd., Palatine, Ill. 60067

[21] Appl. No.: 590,228

[22] Filed: Sep. 28, 1990

[51] Int. Cl.[5] ..... B65D 79/00

[52] U.S. Cl. ..... 220/23.83; 220/23.4; 215/1 C

[58] Field of Search ..... 220/23.83, 23.86, 23.4; 215/1 C

[56] References Cited

U.S. PATENT DOCUMENTS

| | | | |
|---|---|---|---|
| 3,590,989 | 7/1971 | Wittwer . | |
| 3,658,204 | 4/1972 | Bottger | 220/23.86 X |
| 3,732,999 | 5/1973 | Rounkles . | |
| 3,750,890 | 8/1973 | Smith et al. | 220/23.4 X |
| 4,235,343 | 11/1980 | Thompson . | |
| 4,563,186 | 1/1986 | Flynn et al. . | |
| 4,592,478 | 6/1986 | Laconis | 220/23.83 |
| 4,708,253 | 11/1987 | Mednis | 215/1 C X |
| 4,925,066 | 5/1990 | Rosenbaum | 220/23.4 X |
| 4,950,083 | 8/1990 | Bavaveas | 220/23.86 X |

*Primary Examiner*—Steven M. Pollard
*Attorney, Agent, or Firm*—Lee, Mann, Smith, McWilliams & Sweeney

[57] ABSTRACT

A two container system wherein a smaller container is completely nested within a larger container and is frictionally held therein with only one side of the container being exposed. A frictional fitment is provided by a raised bottom portion of the compartment which engages the smaller container for a force fitment at the top thereof. The larger container is preferably provided with recesses in the side wall to provide access to the smaller container.

4 Claims, 1 Drawing Sheet

CONTAINER SYSTEM

BACKGROUND OF THE INVENTION (a) Field of the Invention

This invention relates to a two container system for dispensing a product. More particularly, it relates to a two component container system whereby a smaller dispensing or additive container component is nested within a larger supply container component yet is readily accessible therefrom. The two component system is particularly adapted to dispense medicinal products such as pills or capsules.

(b) State of the Art

It is known in the art to house a small container within a large one. For example, in U.S. Pat. No. 4,563,186 there is described the placement of a fitment 16 in an indent 66 with retention being afforded by frictional engagement at points 74 and 75. In U.S. Pat. No. Des. 100,412, as well as U.S. Pat. No. 4,235,343, there are also shown small containers placed within larger ones. In addition, U.S. Pat. No. 3,590,989 described a smaller container centrally and internally positioned inside a larger container. U.S. Pat. No. 4,592,478 shows recesses in the sides of two containers to accommodate a soap bar whereas U.S. Pat. No. 3,732,999 discloses a recessed compartment in the side wall of the container to store accessory material.

A need still exists for a container system wherein a smaller container can be securely positioned in a larger container yet can be made readily available. Specifically, in the pharmaceutical field there is a need to have a smaller container which can hold a smaller amount of capsules or pills than that contained in the larger container, so that the smaller container can be transported and stored in an easy manner in the larger container. For example, in the treatment of ulcerative colitis with mesalamine, the recommended dosage ranges from two to four capsules four times daily. In such a case, it would be helpful to have a container which would accommodate a daily dosage of the capsules rather than have to transport a larger container with the entire supply of capsules.

It is an advantage of the present invention to provide an improved two-part container system.

It is another advantage of the present invention to provide a two-part container system wherein the smaller container is completely housed or nested within a cavity located centrally in the side wall of the larger container in a manner that is not accidentally removed.

It is yet another advantage of the present invention to provide a container system of the foregoing type wherein the smaller container is securely held within the larger container yet is readily removable therefrom.

It is still another advantage of the present invention to provide a container system of the foregoing type wherein a small container can be securely held in a larger container without requiring any removable parts.

SUMMARY OF THE INVENTION

The foregoing advantages are accomplished and the shortcomings of the prior art are overcome by the present container system wherein a smaller container is nested in a larger container. The first container is formed from a resilient plastic material having a side wall with a compartment recessed therein to receive a smaller container. The compartment has a back wall as well as an enclosed top wall, side walls and a bottom wall which terminate with the side wall of the container. A second smaller container has a profile that substantially matches the compartment, and is frictionally retained within the confines of the recessed compartment.

In one aspect, the compartment has a wall portion which engages the corresponding wall portion of the smaller container.

In another aspect, the container includes two opposed recesses in the side walls to provide access to the smaller container.

In a preferred manner, the smaller container has an enclosed top wall and the top wall of the compartment has a complementary shape.

BRIEF DESCRIPTION OF THE DRAWING

A better understanding of the present container system will be had by reference to the drawing wherein.

DESCRIPTION OF THE PREFERRED EMBODIMENT

Figure 2:
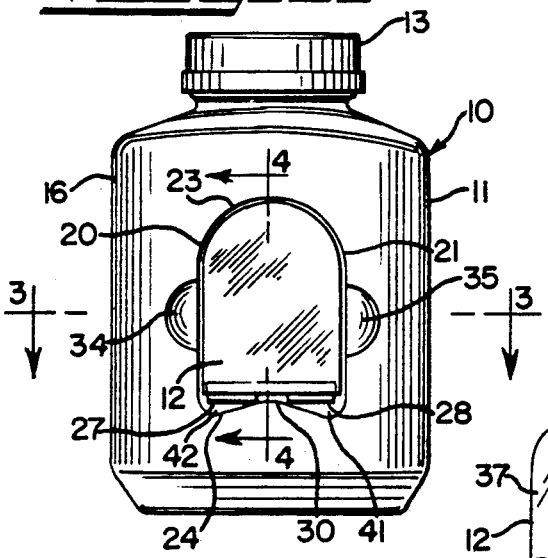
FIG. 2 is a front elevational view of the container system showing the two container components in assembled relationship.
Figure 1:
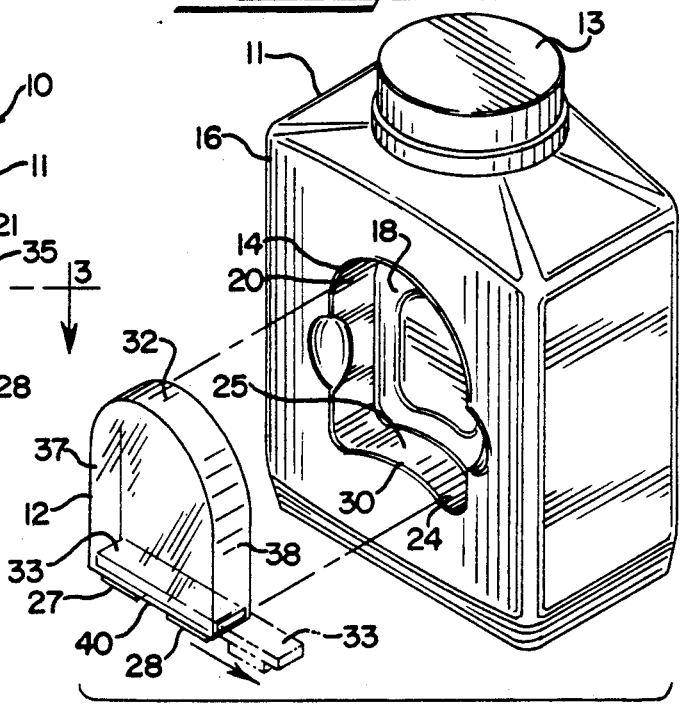
FIG. 1 is a top perspective view of the two component container system showing the smaller container removed from the larger container.

Referring specifically to FIGS. 1 and 2, the container system 10 generally includes a larger container 11 and a smaller container 12. The containers may both be formed from a thermoplastic material which in this instance is high density polyethylene. The container 11 is closed by the usual cap 13 and has a side wall 16 which has a wall thickness of 0.020 to 0.050 inch so as to be resilient or semi-rigid. A compartment 14 is provided centrally in the side wall of 16 for the smaller container 12. This compartment has a back wall 18 as well as peripheral walls which in the illustrated embodiment include two side walls 20 and 21, an enclosed top wall 23 and a bottom wall 24. The two side walls 20 and 21, the top wall 23 and the bottom wall 24 all terminate outwardly with the side wall 16.

The smaller container 12 has a peripheral profile similar to the compartment 14 and includes peripheral walls which in the illustrated embodiment include an enclosed top arcuate wall 32 as well as two side walls 37 and 38 terminating in a bottom portion 40. It has a bottom slide portion 33 positioned between the walls 37 and 38 and encloses the bottom portion 40. When the bottom slide portion 33 is moved outwardly therefrom as shown in broken lines in FIG. 1, a portion of the bottom of the container is open to release some of the contents from the container.

Figure 3:
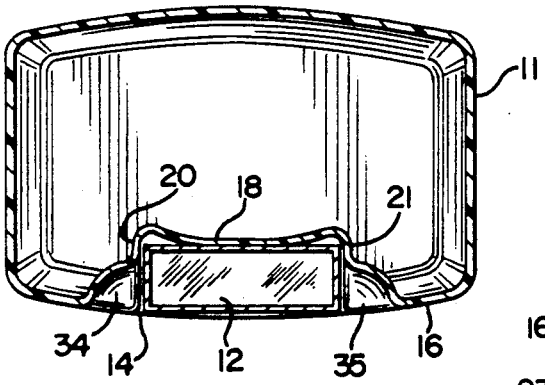
FIG. 3 is a view in horizontal section taken along line 3—3 of FIG. 2.
Figure 4:
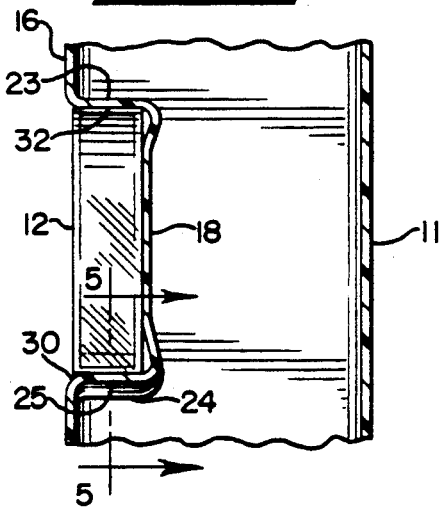
FIG. 4 is a view in vertical section taken along line 4—4 of FIG. 2.
Figure 5:
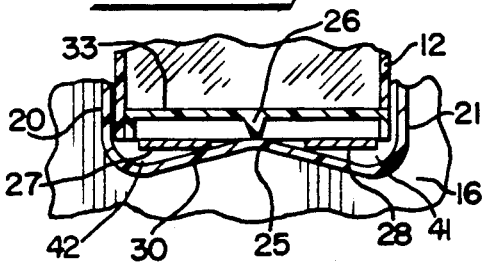
FIG. 5 is a view in vertical section taken along line 5—5 of FIG. 4.

In order to frictionally engage and hold the smaller container 12 within the recessed compartment 14 of the larger container 11 at least one resilient projection which extends inwardly from the peripheral walls of the compartment. In the illustrated embodiment, as best seen in FIGS. 1 and 5, the bottom wall 24 of the larger container compartment is raised such as indicated at 30 and has a ridge-like projection 25 for engagement with the central rib 26 on the slide portion 33 of the smaller container. This is an important feature in retaining the smaller container 12 within the compartment 14 of the larger container 11. The size of the compartment 14 is so designed that a slight forced fitment or frictional engagement between the top wall 32 of the smaller container and the top wall 23 of the compartment when the ribs 25 and 26 engage. The peripheral walls of the compartment 14 are just slighty deeper than the peripheral walls of the smaller container 12. Thus, as is seen in FIGS. 3 and 4, the smaller container 12 is completely nested within the compartment 14 in a manner that no portion of the smaller container projects outwardly from the compartment beyond the plane of the wall 16 of the large container. Even though a forced fitment is provided for the smaller container 12, and it is securely held within the recessed compartment of the larger container, it is essential that the smaller container be readily removable. For facilitating removal of the smaller container 12 from the recessed compartment 14 of the larger container 11, there are provided opposing recesses 34 and 35 in the side wall 16 as best seen in FIG. 3. These recesses provide for easy gripping of the sides 37 and 38 of the smaller container by the finger and thumb of one's hand. Referring specifically to FIG. 2, it is seen that there are the additional recesses 41 and 42 forming a portion of the bottom wall 24. These provide a clearance for the guide flanges 27 and 28 of the slide portion 33 as well as allow for mold release after molding.

The container system 10 is particularly suited for use in conjunction with the dispensing of a pharmaceutical product such as capsules which must be taken in large dosage forms. For example, where as many as sixteen tablets must be taken on a daily basis, it would be inconvenient to carry the larger supply container 11 on one's person. It is more convenient to have the smaller container 12 which can be filled with a daily supply and transported with the recipient. The smaller container 12 can be easily supplied with the larger one by means of the compartment 14. It also provides a place to store the smaller container 12.

An important aspect of the container system 10 is the fact that the smaller container 11 is completely nested within the compartment 14 where no part of the container is thus exposed in a manner that it can be readily engaged and dislodged. Further to consider is the simplicity of the two container system. The container 11 is a unitary construction so that no removable parts are required in order to house the smaller container 12 therein. The only movable component of container 12 is the slidable bottom portion 33, and this is not necessary to effect the frictional retention of the smaller container 12 in the larger container 11.

In the description of the preferred embodiment, the rib 25 on the larger container 11 provides a friction fitment with the rib 26 on the smaller container 12 when in the compartment 14. If desired, this rib could be modified so that it forms a peak or raised portion of the bottom wall 24. Opposing recesses 34 and 35 are illustrated as a means of obtaining access to the smaller container. If desired, only one recess could be employed or both could be eliminated although this is not preferred because these recesses do provide convenient removal of the smaller container. In the absence of such recesses, access to the small container could be obtained by inserting a tool such as a letter opener under the small container 12 such as in the recess 41 and 42. The central location of the recessed compartment 14 prevents the smaller container from being accidentally dislodged from that compartment when the two containers are nested.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

We claim:

1. A container system wherein a small container is nested in a larger container comprising:

a first container formed from a resilient plastic material having a bottom wall and a side wall with a compartment recessed therein to receive a smaller container, the compartment having a back wall and peripheral walls which terminate with the side wall of the container;

a second smaller container having a peripheral profile that substantially matches the periphery of the recessed compartment, the smaller container being completely and frictionally retained within the confines of the recessed compartment with no portions protruding outwardly from the recessed compartment, said recessed compartment being completely surrounded by portions of the side wall, whereby preventing accidental dislodgement of the smaller container from its nested position within said recessed compartment.

2. The container as defined in claim 1 and further including at least one projection extending inwardly from a peripheral wall of the compartment into frictional engagement with a corresponding peripheral wall of said smaller container, whereby said smaller container will be frictionally retained within the confines of the recessed compartment.

3. The container as defined in claim 1 further including at least one recess in a peripheral wall of said first container compartment to provide access to the corresponding peripheral wall of said smaller container, thereby facilitating separation of said smaller container from said first container.

4. The container as defined in claim 3 wherein there are oppositely positioned recesses in the peripheral wall of said first container compartment.

* * * * *